US006299454B1

(12) United States Patent
Henderson et al.

(10) Patent No.: US 6,299,454 B1
(45) Date of Patent: Oct. 9, 2001

(54) STEERING COLUMN INTERCONNECTOR HAVING CONDUCTIVE ELASTIC ROLLING CONTACTS

(75) Inventors: Brent E. Henderson, Ursa; Patrick A. Bolen, Carthage; Brent A. Moormann, Bowen; Sean J. Bollin, Carthage, all of IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 09/533,438

(22) Filed: Mar. 23, 2000

(51) Int. Cl.[7] ..... H01R 39/00
(52) U.S. Cl. ..... 439/19; 439/15; 439/17
(58) Field of Search ..... 439/19, 91, 88, 439/86, 17, 21, 22, 24, 15, 164

(56) References Cited

U.S. PATENT DOCUMENTS 4,904,190 * 2/1990 Plocek et al. ..... 439/15
5,429,508 7/1995 Brevick ..... 439/15
5,575,664 * 11/1996 Sobhani ..... 439/17
5,704,792 * 1/1998 Sobhani ..... 439/21
5,761,048 * 6/1998 Trabucco ..... 361/760
5,775,920 7/1998 Henderson ..... 439/15
5,851,120 * 12/1998 Sobhani ..... 439/17
5,971,781 10/1999 Lagier ..... 439/164
5,975,453 * 11/1999 Sakata et al. ..... 242/388
6,132,219 * 10/2000 Sobhani et al. ..... 439/17

* cited by examiner

*Primary Examiner*—Tho D. Ta
*Assistant Examiner*—James Harvey
(74) *Attorney, Agent, or Firm*—Steven M. Evans

(57) ABSTRACT

A steering column interconnector having a first plate with a center hole for the steering column and a first plurality of conductive rings, a second plate having a center hole for the steering column and a second plurality of conductive rings, a third plate having a center hole for the steering column and a plurality of apertures for rotatably positioning conductive rollers, and a plurality of conductive rollers, each conductive roller being rotatably positioned within an aperture of the third plate.

18 Claims, 3 Drawing Sheets

STEERING COLUMN INTERCONNECTOR HAVING CONDUCTIVE ELASTIC ROLLING CONTACTS

FIELD OF THE INVENTION

The present invention relates generally to clocksprings for steering columns in automotive vehicles. More particularly, the present invention relates to a tapeless clockspring using elastic rolling contacts to provide a steering column interconnector.

BACKGROUND OF THE INVENTION

An increasing number of automobiles have air bag crash systems. The air bag is typically located on the steering wheel facing the driver. The air bag must be in continuous electrical connection with impact sensors in the car body. In the event of a crash, the impact sensor or sensors provide an electrical signal to the air bag crash assembly that instantly inflates the air bag. Accordingly, there is an essential need for a reliable electrical connection between the rotatable portion of the air bag assembly, which is mounted to the steering wheel, and the remaining portion of the assembly, which is mounted to the stationary steering column.

Electrical connections between rotatable and stationary parts are well-known. Typically, an electrical brush rests upon a conductive ring, with one of the parts being rotatable to provide a rotatable electrical connection. However, there is a risk, particularly during the impact of an accident, of transient failure of the electrical connection in the brush and ring system, which could result in failure of the entire air bag system crash assembly.

Accordingly, a clockspring has been previously developed. The clockspring typically includes a flat, flexible ribbon cable wound around a rotatable hub. The rotatable hub is located on the steering column. The ribbon cable is contained within a housing. A first end of the ribbon cable is connected to a deployment unit of the air bag and a second end of the ribbon cable is connected to interconnectors which pass out of the housing. The interconnectors are connected to the impact sensor or sensors on a stationary location of the vehicle. In this manner, the deployment unit for the air bag is reliably connected to the impact sensors of the vehicle.

One of the drawbacks to clocksprings using coiled flat connector cables, or ribbon tapes, is that the steering column must have a "center" position. The clockspring must be mounted on the steering column when it is in it's centered position. This is to prevent the ribbon tape from "running out" if the driver makes a large turn of the steering wheel to the left or the right. Running out of ribbon tape is an inherent problem with clocksprings for steering columns.

Another problem with conventional clocksprings is noise generated by the flat connector cables. When a driver turns the steering wheel with a conventional clockspring to the left or the right, the flat connector cable uncoils or coils up within the steering column. This coiling or uncoiling inevitably produces an audible noise that can be heard by the driver. As consumers become more and more demanding of comfort concerns in their vehicle, undesirable or unpleasant noises are considered unacceptable aspects for vehicle manufacturers.

Following the same theme of customer comfort, more and more vehicle controls are being placed upon the steering wheel. Since modern vehicles typically include airbag systems, the clockspring utilized for the airbag system must also accommodate the electrical connections for vehicle controls. Some of these vehicle controls include turn signals, windshield wipers, lights, cruise, defrost, defog, and horn. Even circuitry for powering a heating element in the steering wheel is being included in the clockspring. Accordingly, more and more electrical connections are being communicated through the clockspring. In a conventional clockspring, this requires more and more individual electrical wires to be crammed into the flat connector cable. A greater number of individual wires in the flat connector cable decreases the flexibility of the cable, and increases the noise generated by coiling and uncoiling a stiffer a cable.

Not only are more features being added to the steering wheel, but devices and controls having higher current demands are also being added. For example, one such feature is a heating element in the steering wheel. A conventional clockspring is not designed to handle such a high current device. Since clocksprings typically utilize thin ribbon cables with low amperage wiring, it can be potentially dangerous for high currents to flow through clocksprings. An uncontrolled high current in a clockspring could damage the vehicle and its instruments. Furthermore, resulting damage to the clockspring could likely defeat a major purpose of the clockspring: providing a reliable electrical connection for the airbag safety system. Moreover, such an uncontrolled current could cause a fire damaging the vehicle and seriously injuring a driver or a passenger.

Accordingly, there is a need for a clockspring design that eliminates the need for a centering position, eliminates the risks of over turning the clockspring, increases the available number individual circuit connections, increases the current load tolerance, and also reduces any noise generated by rotating the clockspring.

OBJECTS AND SUMMARY OF THE INVENTION

An object of the present invention is to eliminate the need for a centered position, which is required in conventional clocksprings using ribbon cables or tapes.

A second object of the present invention is to reduce noise generated in a rotating or stationary clockspring.

Another object of the present invention is to increase the number of distinct circuit channels that may be accommodated by a clockspring.

A further object of the present invention is to increase the available current tolerance of a clockspring.

In accordance with the invention, a steering column interconnector is provided having a first plate with a center hole for the steering column shaft and a first plurality of conductive rings, a second plate having a center hole for the steering column shaft and a second plurality of conductive rings, a third plate having a center hole for the steering column shaft and a plurality of apertures for rotatably positioning conductive rollers, and a plurality of conductive rollers, each conductive roller being rotatably positioned within an aperture of the third plate.

DETAILED DESCRIPTION OF THE PREFERRED EMBODIMENTS

Figure 1:
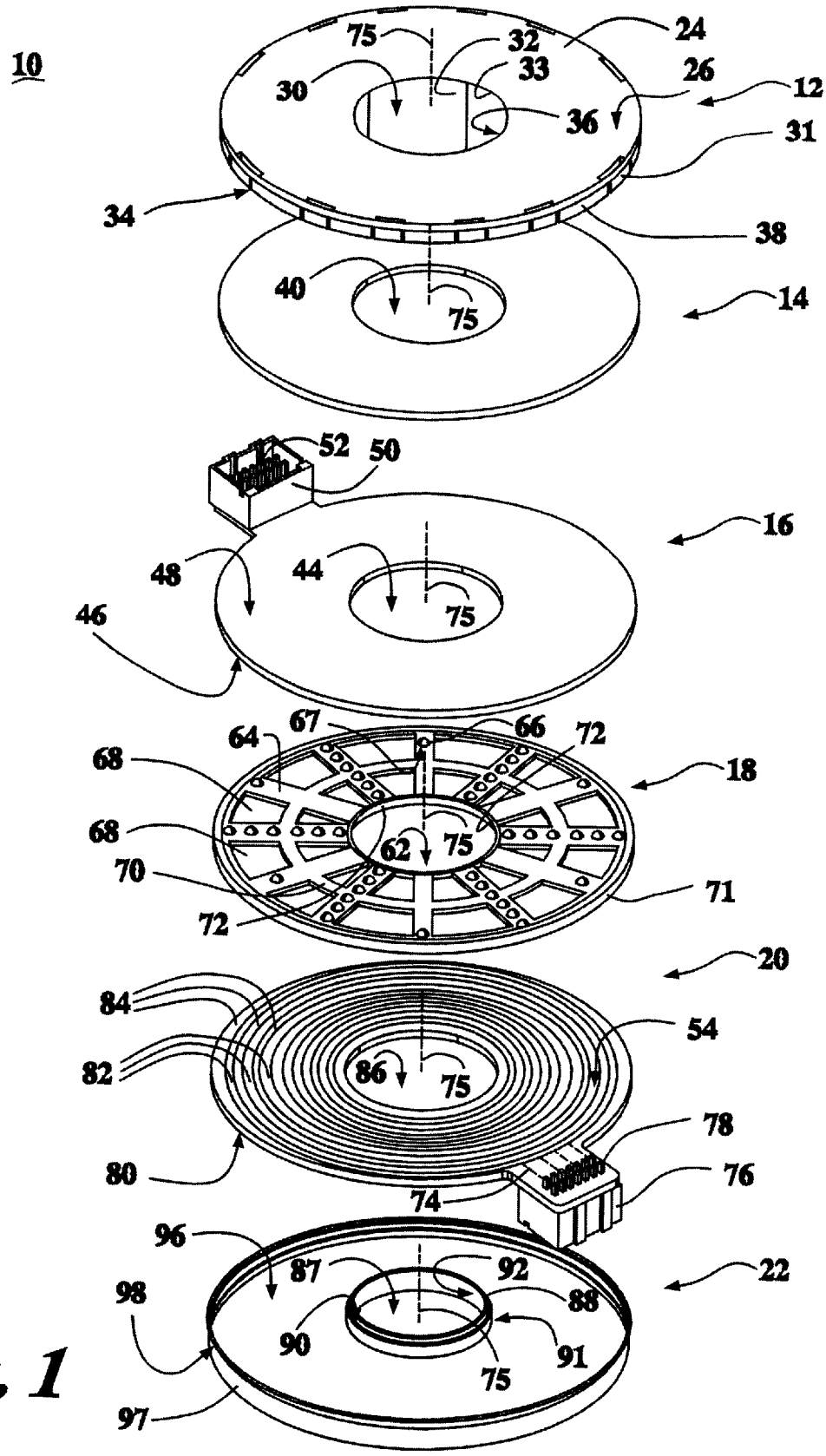
FIG. 1 is a downward looking exploded view of a steering column interconnector configured in accordance with the present invention.
Figure 2:
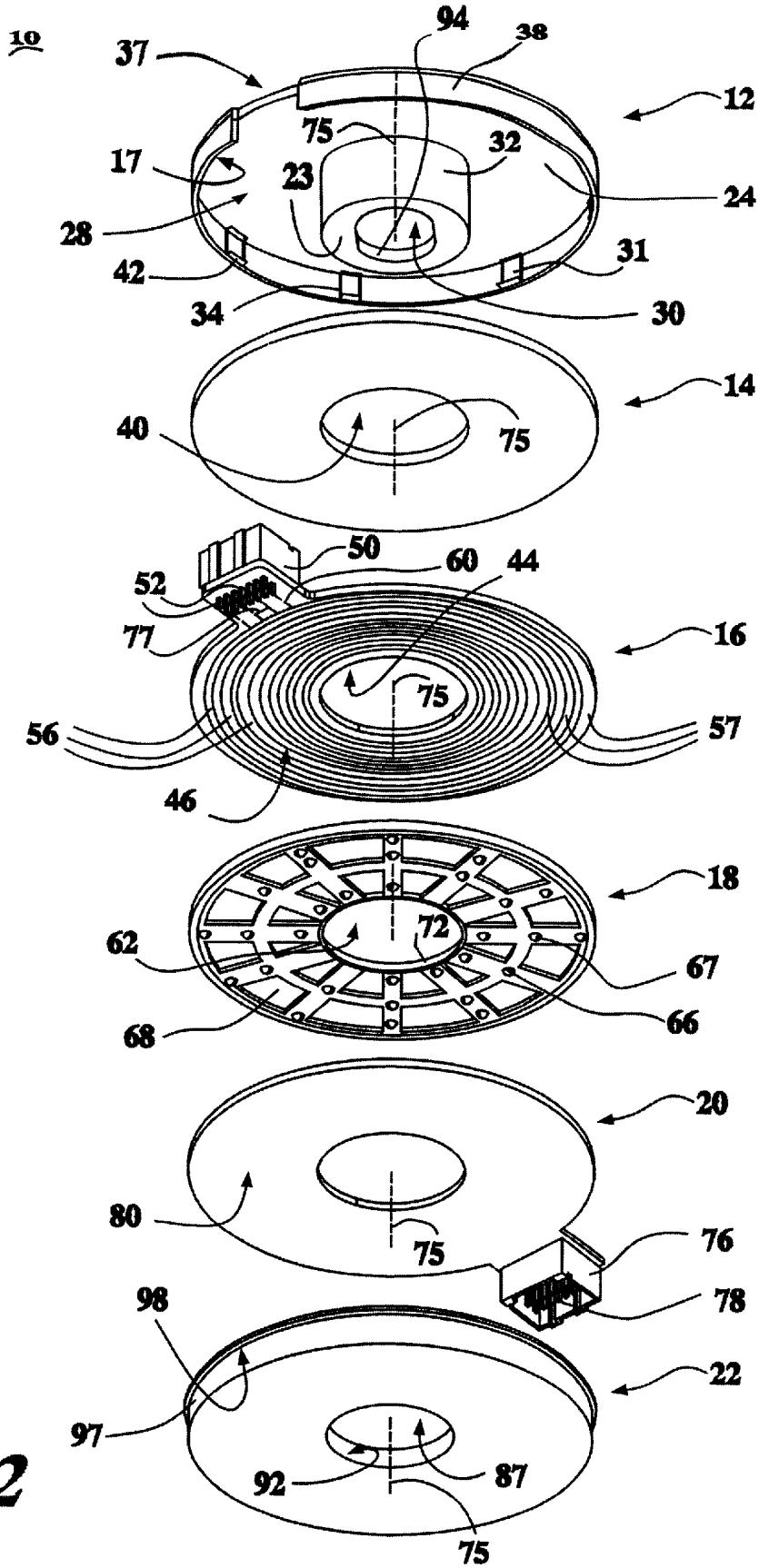
FIG. 2 is an upward looking exploded of the steering column interconnector shown in FIG. 1.

Referring now to the drawings, FIGS. 1 and 2 illustrate an exploded view of a steering column interconnector 10 configured in accordance with the present invention. FIG. 1 provides a downward looking view of the interconnector 10, and FIG. 2 provides an upward looking view of the same interconnector 10. Of course, the terms "downward" and "upward" are used only for ease of description and perspective reference. The steering column interconnector does not actually have a specific top and bottom.

The steering column interconnector or tapeless clockspring 10 includes a hub 12, a pad 14, a first printed circuit board 16, a ball cage 18, a second printed circuit board 20, and a housing 22. The hub 12 includes a circular plate 24 having an outer surface 26 and an inner surface 28. The plate 24 has a hole or bore 30 located in the center of the plate 24. A cylinder 32 is secured within the bore 30 such that an end 33 of the cylinder 32 is flush with the outer surface 26 of the hub 12. An inner wall 36 of the cylinder 32 is configured to fit around a steering column shaft of a vehicle. In a preferred embodiment, the hub 12 and the cylinder 32 are formed into a single component. Typically, the hub 12 and cylinder 32 can be constructed of a durable plastic formed from a mold.

The hub 12 includes a rim 38 extending around the periphery of the plate 24. The rim 38 includes tabs 31 formed by slits 34 in the rim 38. Slits 34 are formed in the rim 38 adjacent to the tabs 31. The tabs 31 are configured to snap onto an edge 98 formed on the housing 22 during assembly of the interconnector 10. The tabs 31 include an inner edge 42 which snaps onto the edge 98 of the housing 22 during the assembly process. Similar to the cylinder 32, the rim 38 and the hub 12 are preferably formed into a single component. The hub 12, including the cylinder 32 and the rim 38, is preferably formed from a durable lightweight material, such as durable plastic.

The hub 12 includes a slot 37 formed in the rim 38. The slot 37 is provided for the socket 50 on the first printed circuit board 16 to fit in during assembly of the steering column interconnector 10. The cylinder 32 may include a lip 23 which functions to properly position the interconnector 10 onto a steering column shaft during assembly. The dashed line 75 indicates the center and axis of rotation of the interconnector 10.

The pad 14 is located between the hub 12 and the printed circuit board 16 during the assembly process. The pad 14 is circular and includes an opening 40 located in the center. The opening 40 is configured to allow the cylinder 32 to pass through. The diameter of the pad 14 is equal to or slightly less than the diameter of the plate 24. The diameter of the pad 14 enables the pad 14 to be placed adjacent to the inner wall 28 of the plate 24, and within the perimeter defined by an inner wall 17 of the rim 38.

After the clockspring 10 is assembled, the pad 14 functions to reduce the noise and rattle of the interconnector 10 during operation and rotation of the interconnector 10. The pad 14 may be made of felt, foam, or other suitable material that enables the hub 12 and first printed circuit board 16 to be positioned against each other while also preventing the hub 12 and first printed circuit board 16 from rattling or producing other noises when the interconnector 10 is stationary or being rotated.

The first printed circuit board 16 is positioned between the pad 14 and the ball cage 18. The first printed circuit board 16 includes an opening 44 sized to enable the cylinder 32 to pass though. The first printed circuit board 16 has an inner surface 46 and an outer surface 48. An electrical connector socket 50 is located on the outer surface 48. The socket 50 includes connector pins 52. Each pin 52 corresponds to a distinct, electrical channel to be communicated by and through the interconnector 10. The pins 52 are preferably constructed of a conductive metal, such as copper. The socket 50 is configured to be mated with a compatible plug on a steering column or steering wheel of a vehicle.

The inner surface 46 of the first printed circuit board 16 has a plurality of conductive rings 56 similar to those on the second printed circuit board 20. Each conductive ring 56 corresponds to a distinct electrical channel that is communicated by and through the interconnector 10. The conductive rings 56 are preferably conductive traces etched out of a substrate on the inner surface 46 of the first printed circuit board 16. However, additive processes for forming the traces may be employed as well. The conductive rings or traces 56 are formed from a conductive material or metal, such as copper. Each conductive ring 56 is separated by a non-conductive ring or non-conductive space 57. The inner surface 46 and conductive rings 56 of the first printed circuit board 16 are preferably flat and smooth. This enables electrical contacts to roll across the conductive traces 56 with minimal resistance and minimal noise.

Each conductive ring 56 is electrically connected to a pin 52 of the socket 50 via a distinct conductive trace 60. Bottoms of the pins 52 are shown extending through and out the inner surface 46 of the first printed circuit board 16. The conductive traces 60 can be etched from a substrate in or on the inner surface 46 of the first printed circuit board 16. The conductive traces 60 are preferably made of a conductive metal, such as copper. The first printed circuit board 16 can be constructed of FR-4, a polymer, or a plastic material suitable for printed circuit boards.

The ball cage 18 is located between the inner surface 46 of the first printed circuit board 16 and the inner surface 54 of the second printed circuit board 20. The ball cage or ball frame 18 is preferably constructed of a non-conductive material such as a polymer material, such as LCP. The ball cage 18 includes an opening 62 at the center of the ball cage 18. The opening 62 is sized to allow the cylinder 32 to pass through. A plurality of ribs or spokes 64 extend from edge 72 of the opening 62. Gaps or spaces 68 are formed between the spokes 64. A circular rib 70 is located between edges 71 and 72 of the ball cage 18 to provide additional support to the spokes 64.

In accordance with the present invention, conductive rolling contacts 66 are rotatably mounted within apertures 67 in the spokes 64. The conductive rolling contacts 66 are spherical in shape and made of a conductive material. The contacts 66 may be made of copper or steel, similar to conventional ball bearings. However, contacts 66 made of steel may rattle within the apertures 67 and be noisy during operation of the clockspring 10. Preferably, the rolling contacts 66 are made of an elastic material that is also electrically conductive. For example, the rolling contacts 66 are made of elastic polymer material that includes conductive particles. The conductive material can be rubber and the conductive particles can be steel, copper, or other conductive metal. The conductive rolling contacts 66 can be made of material similar to the rolling contacts disclosed in U.S. Pat. No. 5,775,920, issued to Brent Henderson on Jul. 7, 1998, which is hereby incorporated by reference.

The rolling contacts or bearings 66 are held within the apertures 67 when the ball cage 18 is positioned between the first and second printed circuit boards 16,20. In other embodiments, the apertures 67 may include curved walls 61 (FIG. 3) which function to hold the conductive rolling contacts 66 within the apertures 67, independent of the first and second printed circuit boards 16, 20, acting to contain the rolling contacts.

The each aperture 67 is spaced radially from the center 75 of the clockspring 10 so as to align with a corresponding conductive ring 56 of the first printed circuit board 16. One or more conductive bearings 66 may be equidistant from the center 75 in order to have multiple conductive bearings 66 contact an individual ring 56 and provide an electrical connection for a specific electrical channel. This can be done to provide redundancy to ensure an electrical connection is maintained between the first and second printed circuit boards 16 and 20. Moreover, multiple conductive rings 56 may electrically connected to each other in order to provide redundancy. This can be achieved by shorting between rings 56 by placing a connection 77 between traces 60.

The second printed circuit board 20 is located between the ball cage 18 and the housing 22. Similar to first printed circuit board 16, the second printed circuit board 20 has a socket 76, pins 78, traces 74, outer surface 80, inner surface 54, conductive rings 82, non-conductive rings 84, and opening 86. Each conductive ring 82 on the second printed circuit board 20 corresponds to a conductive ring 56 of the first printed circuit board 16. Corresponding conductive rings 56,82 are equidistant from the center 75 of the interconnector 10. Furthermore, it should be evident that each corresponding conductive ring 56,82 (those being equidistant from the center 75) share common conductive rollers or bearings 66. Conductive bearings 66, shared by corresponding rings 56,82, provide an electrical connection between each of the corresponding rings 56,82 for each distinct electrical channel of the interconnector 10.

Finally, the housing 22 is located adjacent to the outer surface 80 of the second printed circuit board 20. The housing 22 includes an opening 87 at the center of the hub 12. The opening 87 has a rim 88 with an edge 90 on the outer periphery 91 of the rim 88. An inner surface 92 is sized to allow a steering column shaft to pass through. The edge 90 is sized to mate with an edge 94 of the cylinder 32 of the hub 12. An inner surface 96 of the housing 22 is positioned adjacent to the outer surface 80 of the second printed circuit board 20. A rim 97 is located on the outer periphery of the housing 22. The rim 97 includes an edge 98. During assembly of the interconnector 10, the tabs 31 of the hub 12 include edges 42 which are configured to clip onto the edge 98 of the housing 22. Similar to the hub 12, the housing 22 is preferably constructed of a durable plastic.

Figure 3:
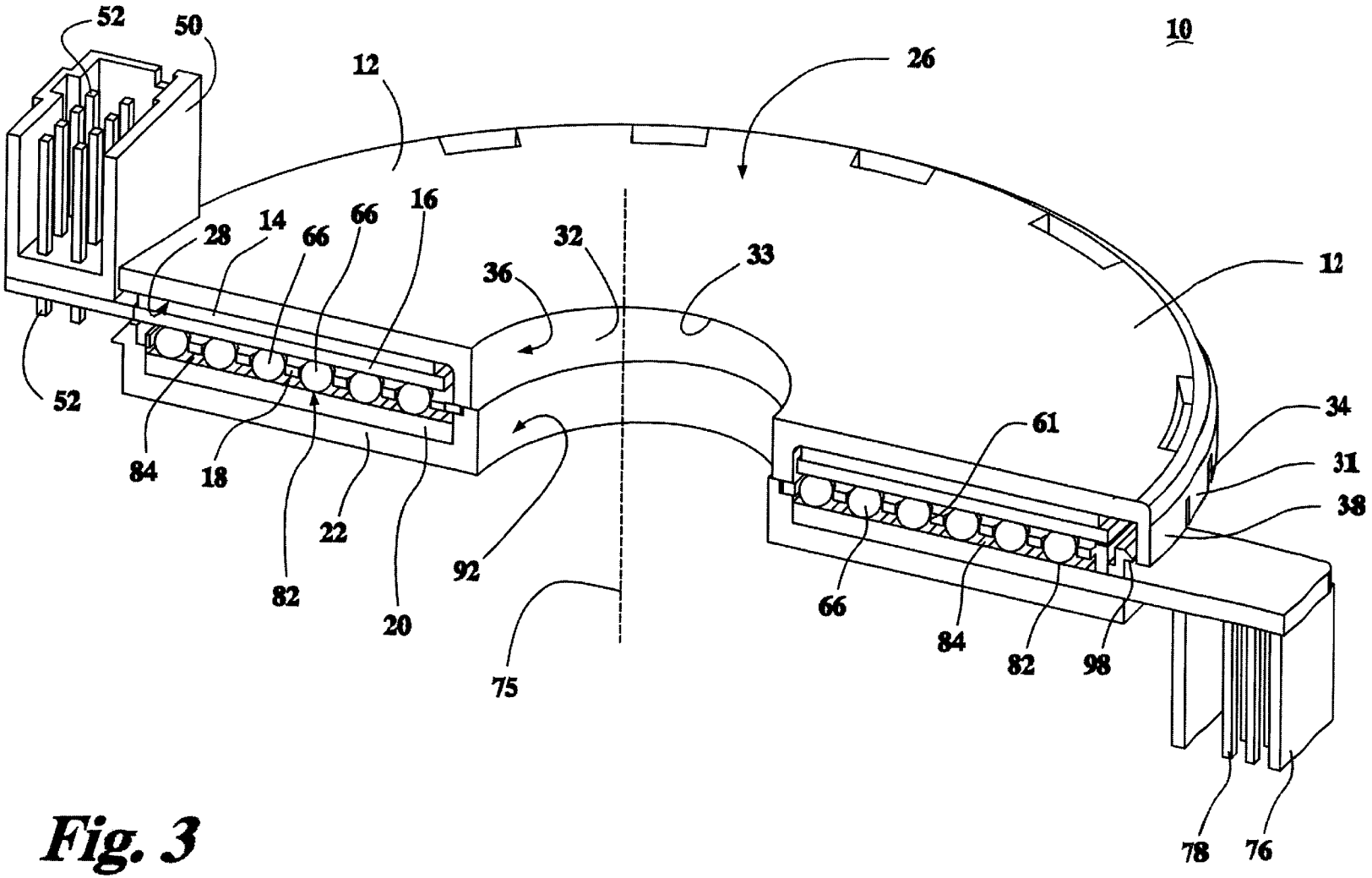
FIG. 3 is a cross-sectional view of the assembled steering column interconnector shown in FIGS. 1 and 2.

FIG. 3 illustrates a cross-sectional view of the steering column interconnector 10 after assembly. The hub 12, pad 14, first printed circuit board 16, ball cage 18, second printed circuit board 20, and housing 22, previously shown in FIGS. 1 and 2, are shown in FIG. 3. The hub 12 and housing 22 are shown mated together. Edge 98 of the housing 22 is positioned inside the rim 38 of the hub 12. The socket 50 of the hub 12 is ready to receive a compatible plug, wherein the pins 52 will connect with electrical contacts of a compatible plug. Similarly, socket 76 having pins 78 is shown ready to receive a mating plug. The pad 14 is positioned snuggly between the inner surface 28 of the hub 12 and the outer surface 48 of the first printed circuit board 16. The conductive elastic rollers 66 are positioned between the first and second printed circuit boards 16,20, and the ball cage 18 holds the conductive elastic rollers 66 in position relative to the center 75 of the interconnector 10.

It is to be understood that the foregoing description is merely a disclosure of particular embodiments and is no way intended to limit the scope of the invention. Several possible alterations and modifications will be apparent to those skilled in the art. Other possible modifications will be apparent to those skilled in the art as all to be defined by the following claims.

We claim as our invention:

1. A steering column interconnector, comprising:

a first circular plate having a center hole for the steering column shaft and a first plurality of conductive rings;

a second circular plate having a center hole for the steering column shaft and a second plurality of conductive rings facing the first plurality of conductive rings; and a third circular plate having a center hole for the steering column shaft and a plurality of apertures for rotatably positioning conductive rollers, said third circular plate being positioned between the first circular plate and the second circular plate, and the apertures, first and second conductive rings all being equidistant from the center hole of the third circular plate;

a plurality of conductive rollers, each conductive roller being rotatably positioned within an aperture of the third circular plate;

a first socket with multiple prongs located on the first circular plate and extending beyond the outer periphery of the first circular plate, wherein each prong corresponds to a separate electrical channel;

first traces on the first circular plate providing a distinct electrical connection between each of the first conductive rings and a corresponding prong on the first socket;

a second socket with multiple prongs located on the second circular plate, wherein each prong corresponds to a separate channel; and second traces on the second circular plate providing a distinct electrical connection between each of the second conductive rings and a corresponding prong on the second socket.

2. The steering column interconnector of claim 1, further comprising:

said third circular plate having a spoked frame configuration, and said conductive bearings are located on spokes of the third plate.

3. The steering column interconnector of claim 1, wherein the conductive rollers are elastic.

4. The steering column interconnector of claim 1, wherein the conductive rollers are made of rubber.

5. The steering column interconnector of claim 1, wherein the conductive rollers are spherical in shape.

6. The steering column interconnector of claim 1, wherein the conductive rollers are made of metal.

7. The steering column interconnector of claim 1, wherein the conductive rollers are composed of conductive particles.

8. The steering column interconnector of claim 1, wherein the first and second conductive rings are composed of copper.

9. The steering column interconnector of claim 1, further comprising:

a hub having a cylinder at the center with a hole for a steering column shaft, wherein the center holes of the first circular plate, the second circular plate, and the third circular plate are mounted around the cylinder; and a pad having a center hole mounted around the cylinder of the hub, and the pad is located between the hub and the first circular plate.

10. The steering column interconnector of claim 1, further comprising:

a housing covering the first circular plate, the second circular plate, and the third plate, and a pad located between the housing and the second circular plate.

11. The steering column interconnector of claim 1, wherein at least two of the first and second conductive traces are electrically connected together to provide redundancy.

12. The steering column interconnector of claim 1, further comprising:

a hub including a cylinder for mounting around a steering column, and a rim on the outer periphery of the hub; and a housing for covering the first circular plate, the second circular plate, and third circular plate, and said housing including a rim on the outer periphery of the housing.

13. The steering column interconnector of claim 12, wherein said rim of the hub including a tab having an edge;

said rim of said housing having an edge; and said edge of said tab clips onto said edge of said housing during assembly to secure said hub and housing together.

14. The steering column interconnector of claim 1, further comprising:

a hub having a cylinder at the center for mounting around a steering column.

15. A tapeless clockspring for a steering column interconnector, comprising:

a hub having a cylinder at the center for mounting around a steering column;

a first printed circuit board having a center hole for passing the cylinder of the hub and the steering column shaft, and the first printed circuit board including a first plurality of conductive rings;

a second printed circuit board having a center hole for passing the cylinder of the hub and the steering column shaft, and the second printed circuit board including a second plurality of conductive rings facing the first plurality of conductive rings;

a ball cage having a center hole for passing the cylinder of the hub and the steering column shaft, and the ball cage including a plurality of apertures for rotatably mounting conductive rollers, said ball cage being positioned between the first printed circuit board and the second printed circuit board;

all said apertures, the first conductive rings, and the second conductive rings being equidistant from the center of the ball cage;

a plurality of conductive rollers, each conductive roller being rotatably mounted within an aperture of the ball cage;

said first printed circuit board, said second printed circuit board, and said ball cage all being circular in shape;

a first socket on the first printed circuit board and extending beyond the outer periphery of the first printed circuit board; and a second socket on the second printed circuit board and extending beyond the outer periphery of the second printed circuit board.

16. The tapeless clockspring of claim 15, further comprising:

a circular flat pad having a hole in the center, and said circular flat pad being positioned adjacent the hub.

17. The tapeless clockspring of claim 15, further comprising:

a housing having a hole in the center, said housing being positioned adjacent to the second printed circuit board.

18. The tapeless clockspring of claim 17, further comprising:

a circular flat pad having a hole in the center, and said circular flat pad being adjacent the housing.

* * * * *